US006416053B1

(12) United States Patent
Kamimura

(10) Patent No.: US 6,416,053 B1
(45) Date of Patent: Jul. 9, 2002

(54) GAME MACHINE

(75) Inventor: Masato Kamimura, Tokyo (JP)

(73) Assignee: Aruze Co., Ltd., Tokyo (JP)

( * ) Notice: Subject to any disclaimer, the term of this patent is extended or adjusted under 35 U.S.C. 154(b) by 0 days.

(21) Appl. No.: 09/449,563

(22) Filed: Nov. 29, 1999

(30) Foreign Application Priority Data

Dec. 4, 1998 (JP) ..... 10-345350

(51) Int. Cl.[7] ..... A63F 7/02
(52) U.S. Cl. ..... 273/121 B; 463/29
(58) Field of Search ..... 273/121 B; 463/16, 463/1, 20, 23, 25, 29

(56) References Cited

U.S. PATENT DOCUMENTS 4,072,930 A 2/1978 Lucero et al.
4,636,951 A * 1/1987 Harlick ..... 463/25
5,741,184 A * 4/1998 Takemoto et al. ..... 273/121 B
5,836,819 A * 11/1998 Ugawa ..... 273/121 B

FOREIGN PATENT DOCUMENTS

| | | |
|---|---|---|
| DE | 3820868 A1 | 7/1989 |
| DE | 4140450 A1 | 6/1993 |
| DE | 4402101 A1 | 8/1995 |
| EP | 0 579 449 A2 | 1/1994 |
| GB | 2 124 418 A | 2/1984 |

* cited by examiner

*Primary Examiner*—Jessica Harrison
(74) *Attorney, Agent, or Firm*—Bacon & Thomas, PLLC

(57) ABSTRACT

A game machine. The game machine includes a main control means (1), a peripheral device (2), a control signal transmission device (3), and a control signal takeout device (4) which takes out control signals transmitted by the main control device (1) via the control signal transmission device (3) to the outside at a point after a connection to the peripheral device (2) and is connectable with a measuring device, such as a tester, an oscilloscope, or a digital analyzer, or an examining tool, such as a personal computer, an exclusive testing monitor.

6 Claims, 7 Drawing Sheets

GAME MACHINE

BACKGROUND OF THE INVENTION

1. Field of the Invention

The invention relates to an improvement of a game machine, such as a ball-flicking type including a so -called "Pachinko", "Arrange-ball", and "Majong-ball", a reel-rotating type called "Pachi-slot", or a slot machine.

2. Description of the Related Art

Prior art game machines allow a special pattern indication device using liquid crystal display, CRT, or a mechanical reel to perform changeable indication corresponding to changes of progress of games, for example, occurrence of a ball's falling into a special operation-start hole, or allow a lamp(s) and/or an amplifier(s) to make unique performance effects. Methods and forms of such changeable indication or unique performance effects become more advanced or complicated corresponding to development of microcomputer technology and advanced needs from players in recent years.

Hence, most of such kinds of game machines are designed, for reducing loads to a micro-processor, to employ a main CPU, which adapted for main control controlling progress of play such as determination of a big bonus winning, and at least one subordinate CPU, which is for indicating patterns and controlling predetermined output means, in order to enable dispersed processing. Usually, such game machine comprises a main control substrate including a main CPU and at least one peripheral controlling substrate formed separately from the main control substrate and including a subordinate CPU, and a signal transmission means such as wiring connecting the substrates to transmit data.

Due to the limit in spaces for installing the substrates or for the purpose of enabling design for specific assemblies, the substrates are generally separated with specific functions and connected via a signal transmission means such as wirings. Furthermore, a detection means detecting conditions that bring changes to progress of play, for example, a special operation-start switch, is provided at a point for making the detection and is connected to the main control substrate via a signal transmitting means such as wiring.

This kind of game machines are subjected to local regulation, i.e., by the Entertainment Establishments Control Law (Japanese Law No. 122 dated Jul. 10, 1948). Hence, the principal parts for the game, such as the main control substrate, and the peripheral control substrate, are accommodated inside the substrate casing and sealed to be prevented frown being shocked or tampered by an unlawful action from the outside.

Not like the electronic parts placed in the substrate casing, the signal transmission means such as wiring may be often stretched through or exposed to the outside air and although the wirings have outer sheaths, the conductive members are not exposed, and are properly collected at the middle on an intervening substrate or retained by a harness or a cable cramp, so that it is unlikely that a long wiring is suspended solely.

However, upon assembling parts during manufacturing, the wirings are possibly broken at its outer sheaths by legs of IC projecting from the substrate, a pointed tool, or any of various protuberances in the working environment, thereby causing a short-circuit or breaking of wire. The wirings could be torn off by an inadvertent handling during removal or transportation. Furthermore, the signal transmission means such as wiring which can be easily accessible or touched from the outside is susceptible to suffer troubles by pranks or unlawful actions.

SUMMARY OF THE INVENTION

The invention was necessitated by the fact that the signal transmission means such as wiring is likely to undergo damages or troubles as stated previously. An object of the present invention is to provide a game machine wherein a signal transmission path consecutively extending from a signal start part to a signal arrival part via wirings can be inspected without the necessity of taking apart the machine body.

The invention defined in an embodiment of the invention is a game machine comprising, as exemplified in FIG. 1, a main control means 1 for controlling progress of play, a peripheral means 2, which a control signal from the main control means 1 is input into in order to actuate an output means 20 to be controlled, and a control signal transmission means 3 connecting the main control means and the peripheral means, wherein there is provided a control signal takeout means 4 which takes out control signals transmitted by the control signal transmission means 3 to the outside at a point after a connection to the peripheral means.

The output means 20 to be controlled may be a special pattern indication device using a liquid crystal display, CRT, mechanical reels, dots-type reels to changeably show patterns consisting of numbers, pictures, etc., to cause players to expect a big winning that opens a large winning hole. The items to be controlled may include an ordinary pattern indication device using 7 segments of LED to changeably show patterns of numbers, signs, etc., to cause players to expect opening of a tulip-type advantageous mechanism, a visible indication device such as LED, LCD, lamps arranged in the play zone, a sound output device such as amplifiers providing sound effects, BGM, sounds of error, or buzzers, or a payoff device for balls or tokens.

The main control means 1 may comprise at least one micro-processor in most cases. The peripheral means 2 when it bears a complicated control as of the special pattern indication may comprise at least one micro-processor, but needs not be so when the output means 20 to be controlled is relatively simple in construction and uses a separate substrate in consideration of spaces. In other words, it is enough for the peripheral means 2 to only bear service of transmitting a control signal from the main control means 1 to the output means 20.

The control signal transmission means 3 may include a single or plural wiring cable(s) , flat cable(s) , flexible printed wiring substrate. The control signal takeout means 4 may use such structures of terminal type such as connectors, receptacles, or direct-formation type such as pin, lands projecting on the substrate. Points where signals are taken out may be input connectors serving as a connection to the peripheral means 2, a patterned part on the substrate extended from the input connectors, and I/O part of CPU provided on the peripheral means 2.

The invention defined in an embodiment of the invention is directed to a Pachinko machine and has an object to enable inspection of wiring at an important part having a large influence on the winning or profit of players. The game machine provides that the output means 20 to be controlled comprises a special pattern indication device for changeably showing a number of patterns including a big bonus winning or losing patterns, and the peripheral means 2 comprises an indication control device for controlling the special pattern indication device.

The invention defined in an embodiment of the invention is a game machine comprising, as exemplified in FIG. 2, a detection means 5 detecting conditions which bring changes to the progress of the game, a main control means 1 controlling the progress of the game in accordance with detection signals from the detection means, and a detection signal transmission means 6 connecting the detection means and the main control means, wherein there is provided a detection signal takeout means 7 which takes out detection signals transmitted by the detection signal transmission means to the outside at a point after a connection to the main control means.

The detection means 5, in case of Pachinko machines, may be a special operation start switch for starting selection between a big winning to open or close a large winning hole, a gate switch for actuating selection between opening or closing a tulip-type advantageous mechanism, a count switch for regulating a maximum of winning balls, or a winning-ball detecting switch. Variation of the detection signal transmission means 6 and detection signal takeout means 7 is the same as the foregoing explanation for the transmission and takeout means 3 and 4 for control signals.

The invention defined in an embodiment of the invention is directed to a Pachinko machine and has an object to enable inspection of wiring at an important part having large influence on benefits of players. The detection means 5 may comprise a detection switch in relation to a big winning control to give players a large profit. The detection switch may cover a special-operation start switch for starting selection between a big winning or a loss, and a count switch for regulating a maximum of winning balls in each round upon a big winning.

The invention defined in an embodiment of the invention enables inspection both of input and output sides with respect to the main control means 1 inclusive of wirings when a specific output means 20 is controlled by the main control means 1. The game machine does, as exemplified in FIG. 3 , comprise a detection means 5 detecting conditions which bring changes to progress of the game, a main control means 1 controlling the progress of the game in accordance with detection signals from the detection means, a peripheral means 2, which a control signal from the main control means is input into to actuate an output means 20 to be controlled, a control signal transmission means 3 connecting the main control means and the peripheral means, and a detection signal transmission means 6 connecting the detection means and the main control means, wherein there are provided a control signal takeout means 4, which takes out control signals transmitted by the control signal transmission means to the outside at a point after a connection to the peripheral means, and a detection signal takeout means 7, which takes out detection signals transmitted by the detection signal transmission means to the outside at a point after a connection to the main control means.

The invention defined in an embodiment of the invention is directed to a Pachinko machine and has an object to enable inspection of wiring at an important part having a large influence on benefit of players, and enable the inspection to be performed at both of input and output side of the main control means 1. The output means 20 to be controlled comprises a special pattern indication device for changeably showing a number of patterns including a big bonus winning or losing patterns, the peripheral means 2 comprises an indication control device for controlling the special pattern indication device, and the detection means 5 comprises a detection switch in relation to a big bonus winning control.

Next, functional effects of those inventions will be detailed.

The invention defined in an embodiment of the invention can simply and easily inspect the control signal transmission means 3 merely by examining signals form the control signal takeout means 4 as shown in FIG. 1. In detail, the control signal takeout means 4 takes out signals at a point after a connection of the control signal transmission means 3 to the peripheral means 2, so that it covers completely the entire length of the control signal transmission means 3 and can inspect short-circuit or breaking of wire thereon. The control signal takeout means 4 which takes out signals to the outside can connect with a measuring device such as a tester, oscilloscope, digital analyzer, or a testing tool such as a personal computer, an exclusively usable test monitor to easily examine levels, its order, timing of control signals and compare and check the examined control signals and actual operation of the output means 20. Accordingly, control signals from the main control means 1 inclusive of the part of control signal transmission means 3 can be inspected, thereby improving function of examining damages and troubles.

The invention defined in an embodiment of the invention enables easy or simple inspection of the control signal transmission means 3 used for a part controlling the special pattern indication device particularly important for the Pachinko machine. In this case, signals taken out by the control signal takeout means 4 are control signals which are transmitted from the main control means 1 via control signal transmission means 3 and are data at a level of commands before being decoded to be developed as actual micro indication signals by the indication control device. Hence, the signals may be checked for enabling plain and clear inspection of the game machine in view of programming specification.

The invention defined in an embodiment of the invention provides easy inspection of the detection signal transmission means 6 merely by examining signals from the detection signal takeout means 7. In detail, the detection signal takeout means 7 which takes out signals at a point after a connection of the detection signal transmission means 6 to the main control means 1 can completely cover the entire length of detection signal transmission means 6 and examine short-circuit and breaking of breaking of wire thereon. The detection signal takeout means 7 which takes out signals to the outside can connect with a measuring device such as a tester, oscilloscope, digital analyzer, or a testing tool such as a personal computer, an exclusively usable test monitor to easily examine levels or other factors of detection signals and compare and check the examined detection signals and actual operation of the detection means 5.

Accordingly, detection signals from the detection means 5 inclusive of the part of detection signal transmission means 6 can be inspected, thereby improving function of examining damages and troubles.

The invention defined in an embodiment of the invention enables easy inspection of detection switch, inclusive of the detection signal transmission means 6, in relation to a big winning control particularly important for the Pachinko machine. A large benefit is given to players upon occurrence of a big winning. The big winning detection switch has hitherto undergone unlawful actions. The present invention allows the main control means 1 to inspect the big winning detection switch easily and clearly, thereby enabling simple checking unlawful actions and providing an effect of restraining any latent criminal activities.

The invention defined in an embodiment of the invention does, as seen in FIG. 3, enables easy inspection of detection signals and control signals at both input and output sides with respect to the main control means 1 inclusive of signal transmission means by examining detection signals from the detection signal takeout means 7 and control signals on the control signal takeout means 4. In this case, progress of play is controlled on the basis of detection signals input into the main control means 1, and the output means 20 is actuated by inputting control signals from the main control means 1 into the peripheral means 2. Hence, signals in relation to a series of controllings can be monitored at the input and output side with respect to the main control means 1. In addition, checking of signals at the input and output sides are performed including the signal transmission means 6 and 3. Hence, a series of control system for a specific output means 20 can be easily inspected.

The invention defined in an embodiment of the invention provides that a series of control system in relation to a big winning control particularly important for the Pachinko machine can be easily performed at both the input and output sides of the main control means 1 inclusive of signal transmission means 6 and 3.

DETAILED DESCRIPTION OF THE PREFERRED EMBODIMENTS OF THE INVENTION

Figure 1:
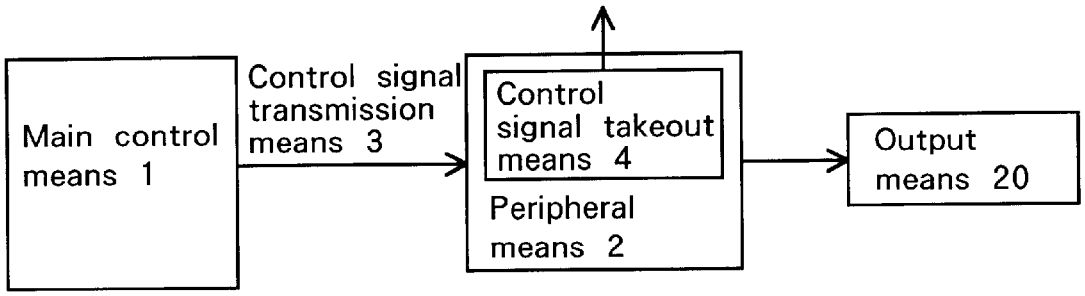
FIG. 1 is a block diagram showing a first embodiment of a game machine according to the present invention.
Figure 2:
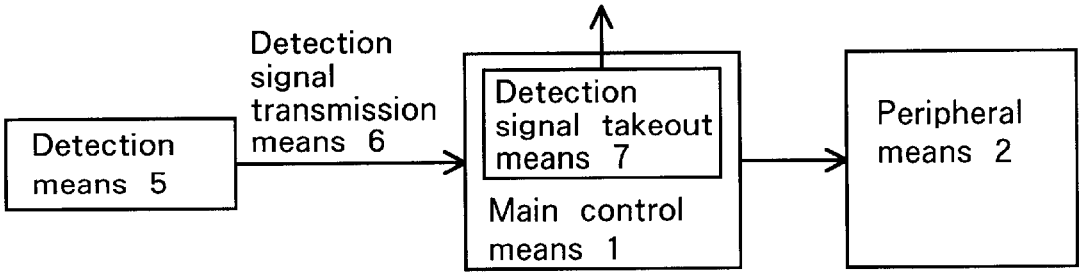
FIG. 2 is a b lock diagram showing a second embodiment of the same.
Figure 3:
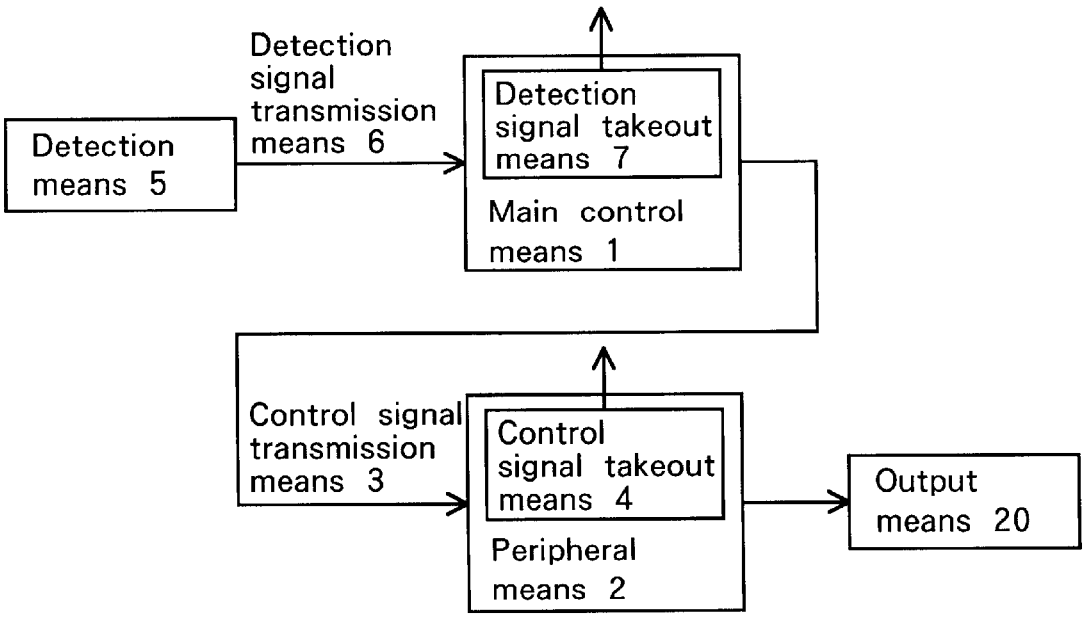
FIG. 3 is a block diagram showing a third embodiment of the same.
Figure 4:
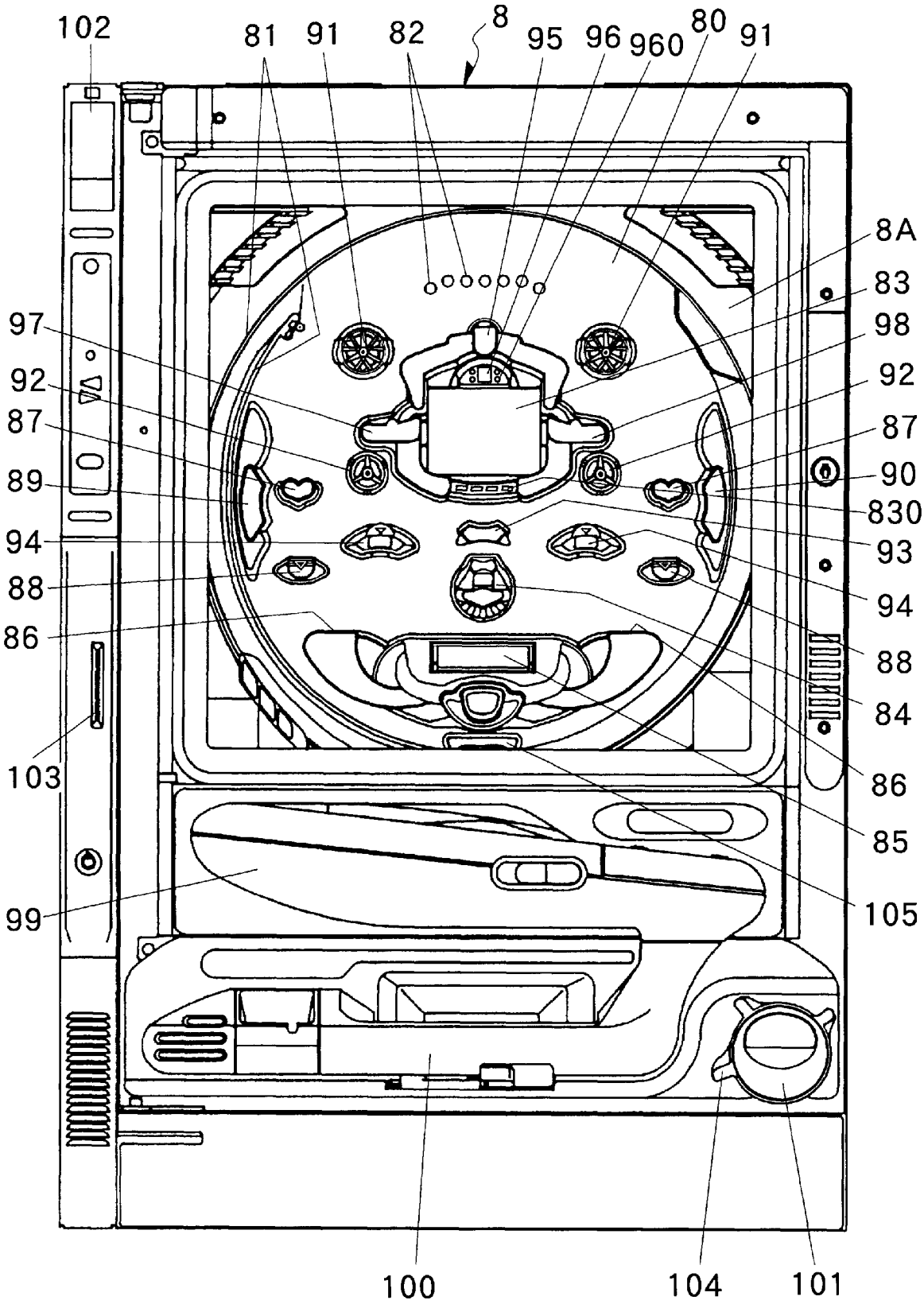
FIG. 4 is a front elevational view of the game machine.

FIG. 4 shows a Pachinko machine 8 to which the present invention is applied to and comprises a game board 80 placed inside a glass window and having a guide rail 81, which defines a game zone and guides flicked balls, a number of pegs 82 mostly omitted except the top ones, a special pattern indication device 83, which uses a liquid crystal display to changeably show on the screen a special pattern formed by left-hand, central and right-hand lines including numbers and signs, a special operation start hole 84 comprising a tulip-type advantageous mechanism , which actuates the changeable indication of the indication device 83 and starts selection of provision of a big winning with a stopped pattern of the same pictures in the left-hand, central and right-hand lines, a big winning hole 85 to open upon the big winning, winning holes 86 laterally of the big winning 85, sidewise winning holes 87 and 88, side lamps 89, 90, lamped windmills 91, ordinary windmills 92, go-through type passage 93 above the advantageous mechanism, and sidewise passages 94. Above the special pattern indication device 83, there are provided a top winning hole 95, ordinary pattern indication device 96 consisting of 7 segments LED and ordinary pattern memory LED960, which memorizes four times at maximum initialization of changes of ordinary patterns when complexed. Laterally of the special pattern indication device, there are provided left-hand and right-hand gates 97 and 98 causing the ordinary pattern indication device 96 to make changeable indication. Below the special pattern indication device is provided a special pattern memory LED830 which memorizes four times at maximum initialization of changes of special patterns when complexed.

Below the game board, there are provided a tray 99 for the balls, a subordinate tray 100 for receiving balls flown from the inside and the upper tray 99 and a launching handle 101 for discharging balls into the play zone on the game board 80 by actuation of an accommodated launching solenoid. 102 is a unit for pre-paid cards, i.e., a so-called "CR sand" (Card Reader Sand Unit), that supplies onto the upper tray 99 balls in number in an extent defined by data memorized in the pre-paid card to be inserted into a card slot 103. A lever 104 at the launching handle 101 may be turned clockwise to shoot a specific ball fed from the upper tray 99 into the play zone on the game board. Players enjoy playing Pachinko, expecting occurrence of big winning. 105 is a hole collecting balls that become lost during play.

Upon winning the ordinary patterns with balls going through the left-hand or right-hand gates 97, 98, the tulip at the start hole 84 is opened in a predetermined time to provide players with increased chances of winning through the special operation start. Time to open may be longer or shorter, and the tulip may be closed when an additional or predetermined number of winning at the start hole 84 occurs. Time to open is determined by values of winning conditions counter that makes plus one due to selection actuated by every ball launched when a pair of ball detection switches a1, a2 in front of the launching solenoid detect a launched ball, and a return ball detection switch a3 does not detect any returning ball not arriving at the play zone. In detail, when the value of the counter is higher than a predetermined value, tulip opening time is 5 seconds, and 0.2 sec when lower than the same. The winning condition counter subtracts one from the value whenever a winning occurs at the operation-start hole 84. When frequency of winning at the special operation start 84 is low, a maximum opening time of tulip due to winning the ordinary pattern is set longer to provide amendment function for keeping constant a rate of winning at the operation-start hole.

Figure 5:
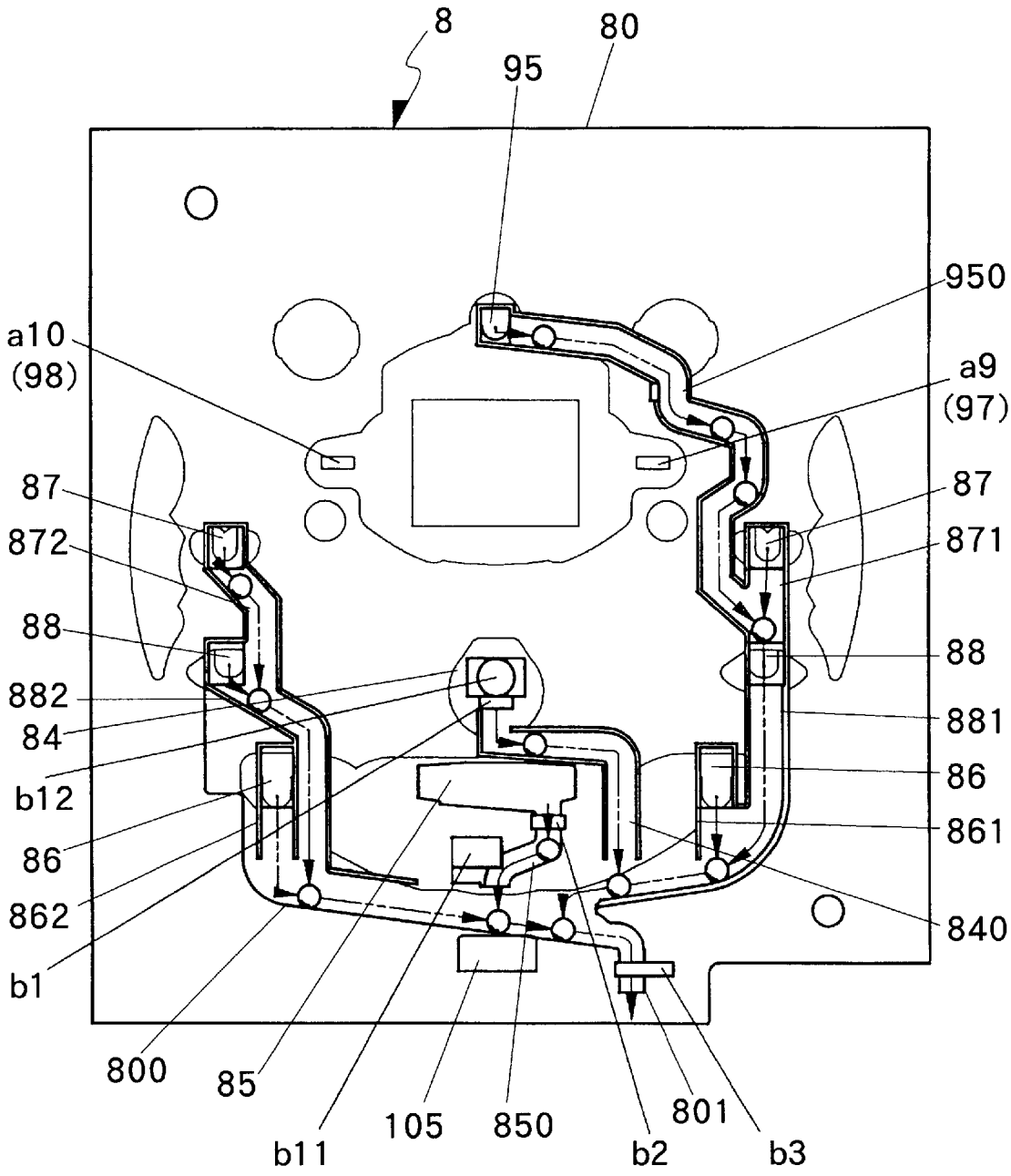
FIG. 5 is a schematic view showing a structure of ball passages formed on the rear of a board provided in the game machine.

FIG. 5 shows a path of balls on the rear side of the game board 80. Balls falling into the winning holes 86, 87, 88 and 95 flow down gutters 861, 862, 871, 872, 881, 882 and 950 to a collecting gutter 800. A ball in an operation-start 84 pass an operation start switch b1 and go through the gutter 840 to the collecting gutter 800. A ball in the big winning hole 85 passes a count switch b2 and go through the gutter 850 to the gutter 800. Balls collected at the gutter 800 first pass a winning ball detection switch b3 and are discharged through ball exit 801 to an installation for mounting the Pachinko machines.

In FIG. 5, b11 is a motor for opening and closing an attacker 85, b12 solenoid for opening and closing tulip at the operation-start hole 84, and a9 and a10 gate left-hand switch and gate right-hand switch which detect balls passing through the left-hand and right-hand gates 97,98 to actuate changeable indication of the ordinary pattern indication device 96 and selection between the winning and losing. Balls obtainable for every winning in the operation-start 84 and ordinary holes 86, 87, 88 and 95 may be six, and that in case of the big winning hole 85 may be 15. The count switch b2 has a function of regulating the maximum winning number to close the big winning hole 85 when the number of winning at the hole 85 becomes 10, even before the maximum opening time 30 seconds elapses in each round of big winning. The counter switch b2 allows transition to the next round, i.e., continuation of rounds when any one winning occurs at a V-winning timing set in an initial 5 seconds and 5 seconds from 15th to 20th second after the start of opening the big winning hole 85 during its maximum open time of 30 seconds. Rounds to be continued that are allowed for each big winning is 16 times at maximum.

Figure 6:
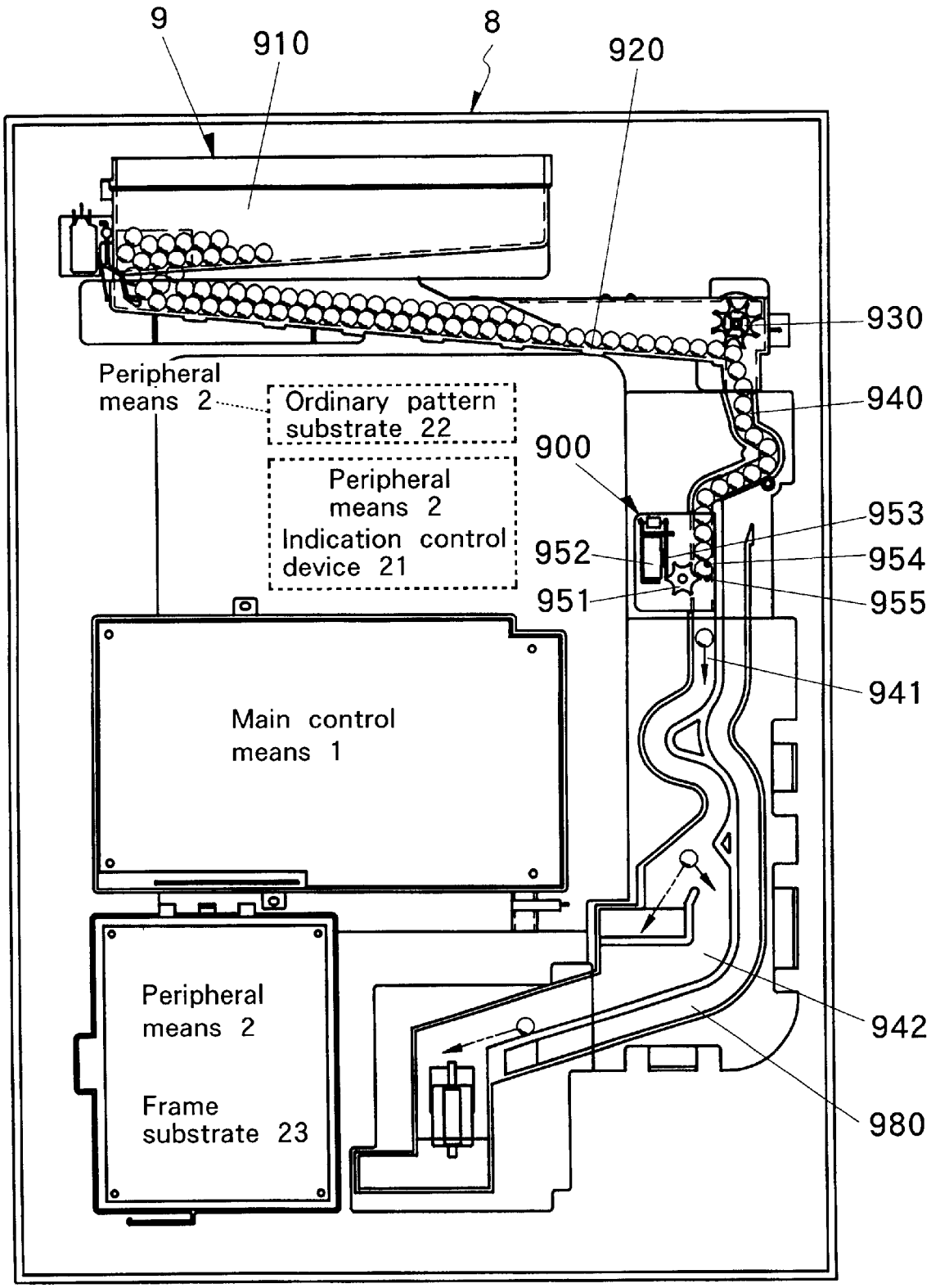
FIG. 6 is a schematic view showing a structure of a mechanism formed on the rear of the game machine.

FIG. 6 shows a mechanism of the Pachinko machine 8 provided with a container 910 for balls supplied at the installation thereof, lining gutter 920, flow-regulating sprocket 930, flow-down gutter 940, and payoff device 9 having winning ball device 900. The winning ball device 900 is provided with a payoff solenoid 952 serving as an output means to operate a sprocket type control member 951. The sprocket type control member 951 is retained by a movable member 953 of the solenoid 952 to stop paying off balls, and the movable member 953 may be taken up to make free the control member 951, thereby performing paying off balls. Balls are counted by a pair of ball number detection switches 954, 955 having light emitting and receiving parts, respectively, thereby providing a predetermined number, 15 or 6, of prize balls. 941 is a flow down gutter extended from an outlet of the winning ball device 900, 942 a diverged gutter guiding balls flown over from the upper tray 99 to the lower tray 100, and 980 a gutter for flowing balls from the container 910.

In FIG. 6, 1 is a main control means for controlling progress of play, which centrally performs various controls of, such as changeable indication of special pattern indication device 83 following the operation-start winning, opening of the big winning hole 85, changeable indication of ordinary pattern indication device 96 following ball's flowing through the left-hand and right-hand gates, opening of tulip type advantageous mechanism, prize balls payoff due to winning, control of various lamps, and sounds from amplifiers.

In FIG. 6, 2 is a peripheral means which receives a control signal from the main control means 1 to actuate a specific output means 20, and includes an indication control device 21 comprising a liquid crystal control substrate for controlling the special pattern indication device 83 as the output means 20, an ordinary pattern substrate 22 transmitting signals to the ordinary pattern indication device 96 as output means 20, and a frame substrate 23 for controlling the winning ball device 900 as output means 20. Not shown in FIG. 6 are a substrate for control launching such as solenoid and intervening substrates for relaying signals.

Figure 7:
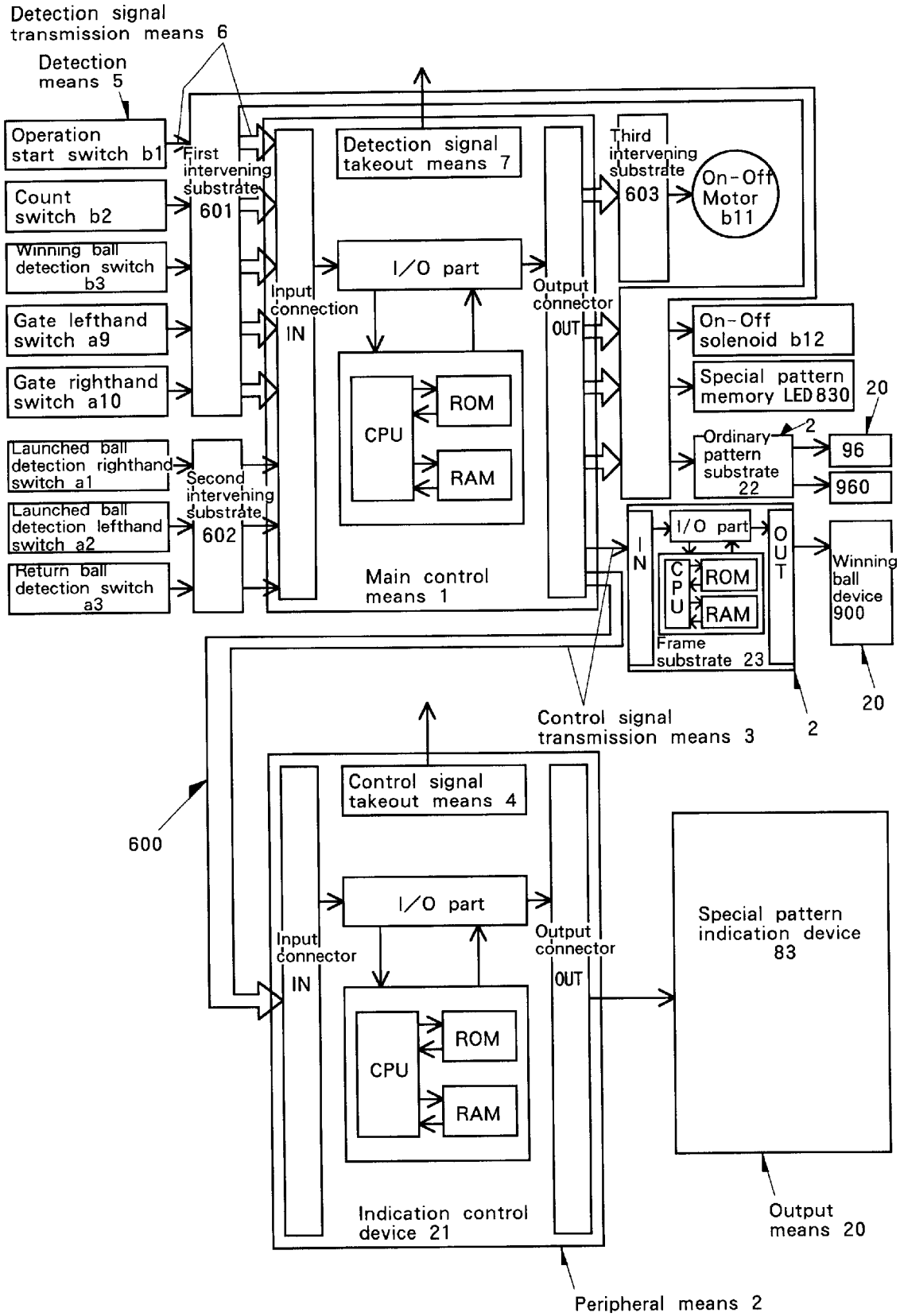
FIG. 7 is a block diagram showing correlation of specific parts connected with respect to the main control means.

FIG. 7 is a schematic block diagram showing correlation of connection between the main control means 1 and the peripheral means 2. Detection means 5 detects conditions that bring changes to the progress of the game, such as changeable indication of the special pattern or ordinary pattern are connected to an input connector IN of the main control means 1 via detection signal transmission means 6. Operation-start hole switch b1 count switch b2, winning ball detection switch b3, gate left-hand switch a9, gate right-hand switch a1 0 each constituting the detection means 5 are connected to the main control means 1 with their wirings being supported on a first intervening substrate 601. Launched ball detection right-hand switch a1, left-hand switch a2, return ball detection switch a3, each constituting the detection means 5 are connected to the main control means 1 with their wirings being supported on a second intervening substrate 602.

The main control means 1 is connected at its output connector OUT with the indication control device 21, ordinary pattern substrate 22 and frame substrate 23 constituting a peripheral means 2 through a control signal transmission means 3. The middle part of the control signal transmission means 3 extending to the ordinary pattern substrate 22 together with solenoid b12 of the tulip type advantageous mechanism and special pattern memory LED 830 are relayed by the first intervening substrate 601. An intermediate part of signal transmission means extending to the motor b 11 of big winning hole is relayed on the third intervening substrate 603. In FIG. 7, the part of signal transmission means indicated by hollow arrows comprises a single flexible printed substrate using a flexible film with wiring patterns at input and output sides integrally formed by printing.

The indication control device 21 and frame substrate 23 of the main control means 1 and peripheral means 2 are provided with a micro-processor part including central processing unit CPU, read only memory ROM, and random access memory RAM and are connected to the input connector IN and output connector OUT through I/O part that exchanges data with bus line.

Figure 8:
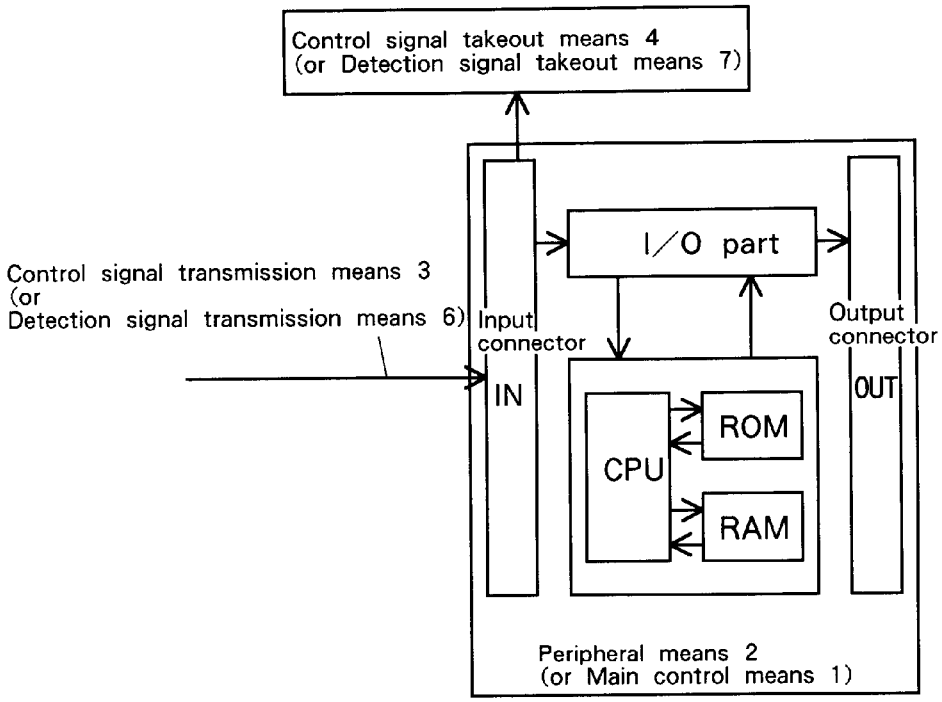
FIG. 8 is a block diagram showing a first example of a signal takeout means.

FIG. 8 shows a first embodiment of a control signal takeout means 4, which takes out control signals transmitted by the control signal transmission means 3 at a point after a connection to a peripheral means 2 such as a indication control device 21 to the outside, or a detection signal takeout means 7, which takes out detection signals transmitted by detection signal transmission means 6 at a point after a connection to the main control means 1. In this case, a signal takeout terminal is integrally formed at the connector IN part to connect with a measuring device or testing tools.

Figure 9:
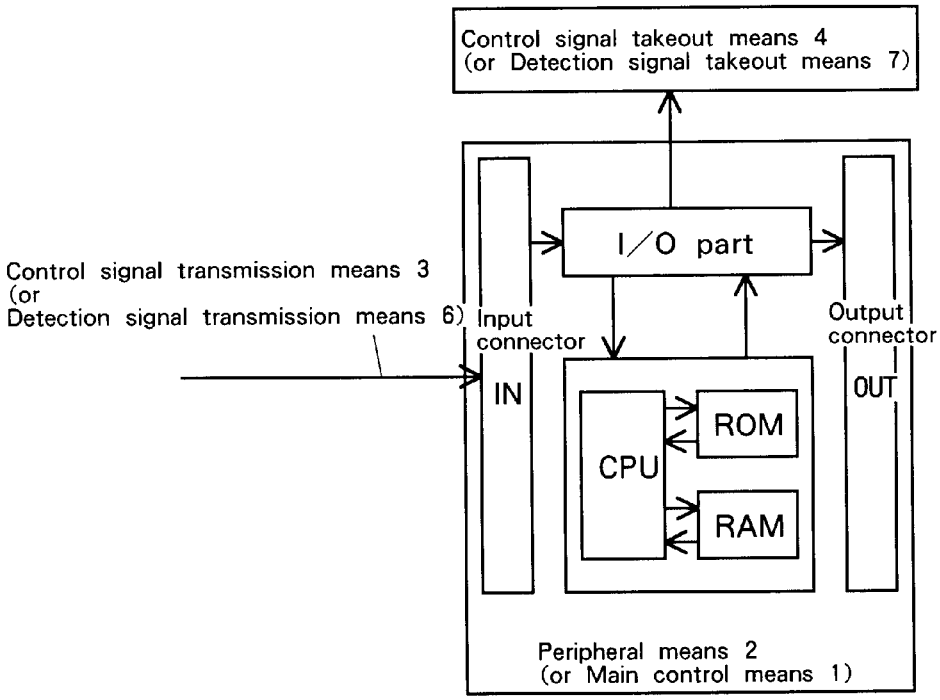
FIG. 9 is a bloc k diagram showing a second example of a signal takeout means.

FIG. 9 shows a second embodiment of the control signal takeout means 4 or detection signal takeout means 7. In this case, pins, through-holes, lands, or connectors may be provided on the way of wiring pattern extending from output, for example, of input buffer, forming the I/O part, thereby enabling connection with measuring devices or testing tools.

Figure 10:
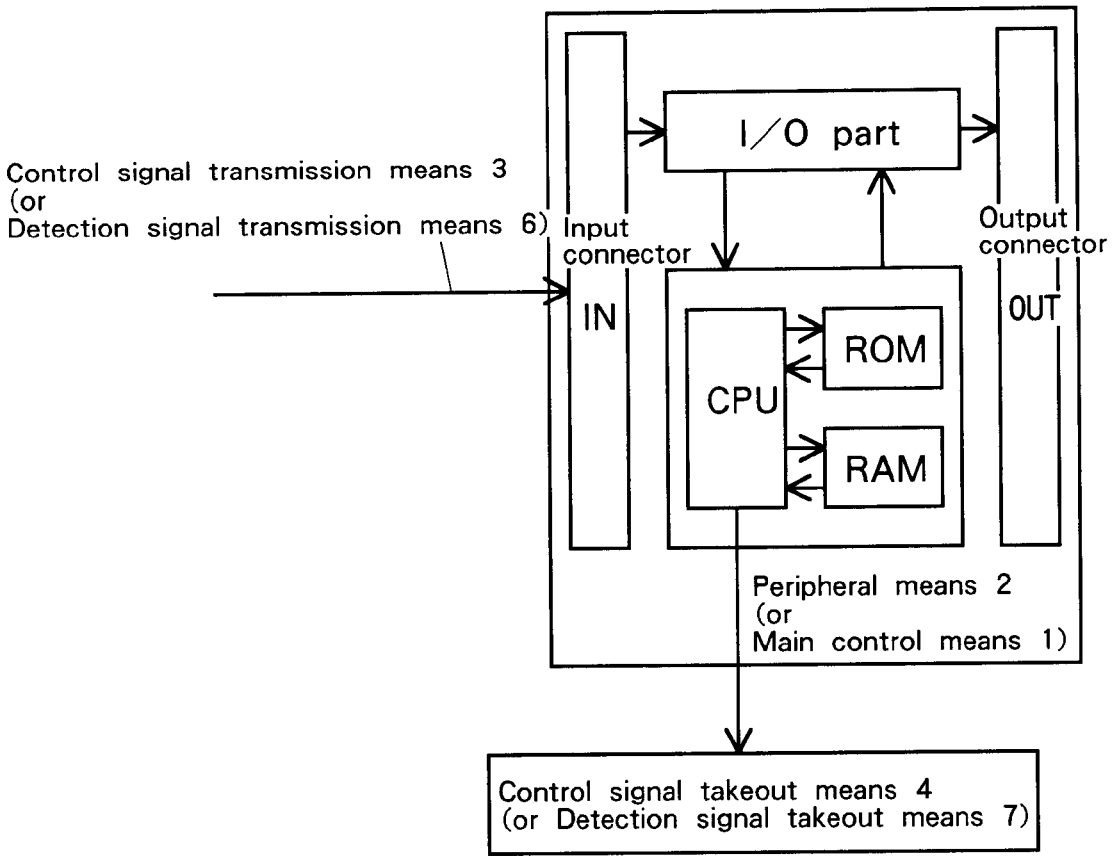
FIG. 10 is a block diagram showing a third example of a signal takeout means.

FIG. 10 shows a third embodiment of the control signal takeout means 4 or detection signal takeout means 7. In this case, signals which first input in CPU and taken out through output port can be monitored. Pins, through-holes, lands, connectors may be provided on the way of wiring pattern extending from the output port, thereby enabling connection with measuring devices or testing tools.

The control signal takeout means 4 and detection signal takeout means 7 do not need the same construction. The structures of FIGS. 8 to 10 may be used in proper combination. For example, the control signal takeout means 4 may use a structure of FIG. 9 while the detection signal takeout means 7 may be structured as in FIG. 8. Though not shown, in FIG. 8, pins, through holes, lands, connectors may be provided on the way of wiring pattern extending from the input connector IN, thereby enabling connection with measuring devices or testing tools.

In the above, explanation is omitted for control of various lamps and sounds from amplifiers. The control may be carried out as the peripheral means with respect to the main control means with the present invention applied to the parts for controlling lamps or sounds. Furthermore, the above explanation is given with referring to an example of Pachinko machine. The invention may be applicable also to other ball-flicking type machines such as arrange-ball, majong ball, or reel-rotation type machine such as Pachisulo, or a slot machine wherein token payoff device or reel control device may be conceived as the peripheral means with respect to the main control means.

What we claimed is:

1. A game machine comprising:

a detection means comprising a detection switch that detects actual progress of the game machine;

a main control means comprising a microprocessor;

a detection signal transmission means comprising a connection connecting the detection means to the main control means;

a detection signal takeout means adapted for transmitting detection signals from the detection signal transmission means, the detection signals are transmitted by the detection signal transmission means and are input into the main control means;

the main control means is adapted for controlling progress of play of the game machine in accordance with the detection signals from the detection means;

a control signal transmission means comprising wiring connecting the main control means and a peripheral means;

the peripheral means is given an input of a control signal from the main control means via the control signal transmission means to actuate an output means that is adapted to control an indication control device such that a pattern indication device changeably shows a plurality of patterns;

a control signal takeout means comprising connectors each of which has an output terminal adapted for transmitting control signals from the control signal transmission means, the control signals are transmitted by the control signal transmission means and adapted to be input into the indication control device to actuate the pattern indication device, the connectors of the control signal takeout means are positioned at a point after a connection between the control signal transmission means and the indication control device; and the connectors of the control signal takeout means are connected to a signal measuring device and signals received by the control signal takeout means from the control signal transmission means are compared with the detection signals from the detection signal takeout means to indicate operational anomalies by the signal measuring device.

2. The game machine as claimed in claim 1, wherein the connectors are receptacles.

3. The game machine as claimed in claim 1, wherein the connectors are pins.

4. A method of inspecting a game machine, the steps comprising:

providing a detection means comprising a detection switch that detects actual progress of the game machine;

providing a main control means comprising a microprocessor;

providing a detection signal transmission means comprising a connection connecting the detection means to the main control means;

providing a detection signal takeout means adapted for transmitting detection signals from the detection signal transmission means, and transmitting the detection signals from the detection signal transmission means and inputting the detection signals into the main control means, wherein the main control means is adapted for controlling progress of play of the game machine in accordance with the detection signals from the detection means;

providing a control signal transmission means comprising wiring connecting the main control means and a peripheral means, wherein the peripheral means is given an input of a control signal from the main control means via the control signal transmission means to actuate an output means that is adapted to control an indication control device such that a pattern indication device changeably shows a plurality of patterns;

providing a control signal takeout means comprising connectors each of which has an output terminal adapted for transmitting control signals from the control signal transmission means, and transmitting the control signals from the control signal transmission means and inputting the control signals into the indication control device to actuate the pattern indication device, wherein the connectors of the control signal takeout means are positioned at a point after a connection between the control signal transmission means and the indication control device; and connecting the connectors of the control signal takeout means to a signal measuring device and comparing signals received by the control signal takeout means from the control signal transmission means with the detection signals from the detection signal takeout means to indicate operational anomalies by the signal measuring device.

5. The method of inspecting a game machine as claimed in claim 4, wherein the connectors are receptacles.

6. The game machine as claimed in claim 4, wherein the connectors are pins.

* * * * *